US005807409A

United States Patent [19]

Moore et al.

[11] Patent Number: 5,807,409

[45] Date of Patent: Sep. 15, 1998

[54] METHOD OF IMPROVING PULL-UP CHARACTERISTIC OF LEATHER SUBSTRATE AND MODIFIED FINISHING OIL USED THEREIN

[75] Inventors: John Shaftoe Moore, Chalfont; Robert Howard Gore, Southampton, both of Pa.; John Hawthorn, Bristol, United Kingdom

[73] Assignee: Rohm and Haas Company

[21] Appl. No.: 739,918

[22] Filed: Oct. 30, 1996

[51] Int. Cl.[6] ..... C14C 11/00

[52] U.S. Cl. ..... 8/94.21; 8/92.22; 8/94.23; 252/8.57; 427/389; 428/473

[58] Field of Search ..... 8/94.21, 94.22, 8/94.23; 252/8.57; 427/389; 428/473

[56] References Cited

U.S. PATENT DOCUMENTS

| | | | |
|---|---|---|---|
| 3,231,420 | 1/1966 | Lowell et al. | 427/473 |
| 4,780,222 | 10/1988 | Amati | 8/94.33 |
| 5,330,537 | 7/1994 | Stewart et al. | 8/94.1 R |
| 5,442,013 | 8/1995 | Bauer et al. | 525/309 |

FOREIGN PATENT DOCUMENTS

| | | |
|---|---|---|
| 569639 | 11/1993 | European Pat. Off. . |
| 690081 | 3/1996 | European Pat. Off. . |

OTHER PUBLICATIONS

"Synthetic fatliquors in theory and practice", Dr. Th Bohme, Science and Technology, p. 40, 42, 43, 80 and 81 (Date Unknown).

Henkel Corp., Oak Creek, Wisconsin, Material Safety Sheet, Product—Aversin KCO (Date Unknown).

"The Characterization of Polymers", Rohm and Haas Co., Phila., PA., CM–106 Sep. 1976, pp. 4,6,7.

"Fatliquors and Fatliquoring of Leather", Samir Das Gupta, Atlas Refinery, Inc., Newark, NJ, pp. 1–23. (Date Unknown).

"Pocket Book for the Leather Technologist", BASF Aktiengesellschaft, D–6700, Ludwigshafen, Germany, pp. 139–151. (Date Unknown).

*Primary Examiner*—Alan Diamond
*Attorney, Agent, or Firm*—Sudhir G. Deshmukh

[57] ABSTRACT

The present invention provides for a method of improving the pull-up characteristic of a leather substrate darkened with a finishing oil modified by dissolving a modifier in a conventional finishing oil. The modifier may be polymerized from a monomer mix of alkyl acrylates and alkyl methacrylates. Improved pull-up characteristic of a leather substrate is esthetically very appealing and is highly desired by a consumer. The modifier of the present invention increases the viscosity of the finishing oil, thereby extending the open time, which is a time duration during which the oil applied over the leather substrate surface stays on the surface. Increased open time permits a manufacturer to spread the oil over more area of the leather substrate than conventional unmodified finishing oils, without substantially affecting the pull-up characteristic of a leather substrate darkened with the finishing oil.

16 Claims, No Drawings

METHOD OF IMPROVING PULL-UP CHARACTERISTIC OF LEATHER SUBSTRATE AND MODIFIED FINISHING OIL USED THEREIN

The present invention generally relates to a method of finishing leather substrates and more particularly relates to improving the pull-up characteristic of finished leather substrates and a modified finishing oil used to therein.

Prior to subjecting a leather substrate to a typical finishing step, raw hide, pelt or skin obtained from animal cadavers, undergoes several steps before it is converted into an esthetically pleasing, physically strong and pliable finished leather substrate. Raw leather substrate typically undergoes two distinct sets of process steps. First typically being a wet process during which initially hair from the grain side and any remaining tissues from the flesh side of the skin are removed. The raw hide, pelt or skin is then converted by tanning and then drying operations into a crust leather substrate.

During a typical second set of steps, the crust leather substrate is generally mechanically softened by pulling and stretching, after which it is subjected to a finishing process, which typically involves a variety of methods, such as, for example, applying pigmented or clear films, or applying layers of dyes, oils or waxes on the grain side of the leather substrates. One of the increasingly important finishing processes involves applying a finishing oil on a leather substrate, which results in darkening the grain side of the finished leather substrate. This leather finishing process is also commonly referred to as the "oiling-off" process. One of the important characteristic of this type of darkened leather substrate is its "pull-up" characteristic, which is typically observed when the flesh side of leather substrate is stretched and pulled over a hard blunt edge to produce lightening of color on the grain side of the leather substrate surface. The pull-up characteristic is also observed when the flesh side of a darkened leather substrate is pulled hard over the knuckles of a person, thereby producing lightening of color on the grain side of the leather substrate. Such a lightening of color on the grain side of the leather substrate surface typically recedes when the lightened area on the grain side surface of the leather substrate surface is rubbed under digital pressure. Higher the degree of lightening produced on the grain side of the leather substrate, higher will be the pull-up characteristic of the darkened leather substrate surface, which is considered esthetically more pleasing by a consumer.

One of the major problems encountered with conventional finishing oils used in improving the pull-up characteristic of the darkened leather substrate surface, is their tendency to migrate away from the grain side to the flesh side of the leather substrate. As a result, less than desired amount of finishing oil stays on the grain side of the leather substrate surface. It is necessary to have more, not less, amount of finishing oil available on the grain side of the leather surface for improving the pull-up characteristic to the leather substrate. The present invention solves this problem by modifying the conventional finishing oil to reduce the rate of migration from the grain side to the flesh side of the leather substrate. As a result, more of the finishing oil stays on the grain side substrate surface thereby helping in improving the pull-up characteristic to the leather substrate.

Furthermore, since the modified finishing oil of the present invention substantially stays on top of the leather surface for a longer period of time, a significantly longer "open time" is advantageously provided. "Open time" means the time duration available to a manufacturer during which the finishing oil is spread over the grain side of a leather substrate before it is absorbed within the leather substrate. Thus, the longer open time provided by the modified finishing oil of the present invention, permits a manufacturer to cover up to 30 percent more surface area of a leather substrate when compared to conventional finishing oils. Furthermore, such an increase in leather surface coverage is attained without substantially adversely affecting the pull-up characteristic of the leather substrate.

Yet another advantage of the method and the composition of the present invention is less soiling of any clothing, such as, socks worn by a person, resulting from lesser amounts of finishing oil migrating from the grain side of a leather substrate, such as, shoe, to the flesh side, which typically comes in contact with the clothing.

The present invention is directed to a method of improving the pull-up characteristic of a leather substrate comprising:

dissolving a modifier in a finishing oil to form a modified finishing oil for increasing the viscosity of said finishing oil by from 10 percent to 500 percent;

applying a layer of said modified finishing oil to said leather substrate to improve its said pull-up characteristic over that provided by said finishing oil.

The present invention is further directed to a modified finishing oil suitable for improving the pull-up characteristic of a leather substrate comprising:

a finishing oil and;

a modifier dissolved in said finishing oil to form a modified finishing oil, wherein said modifier is polymerized from a monomer mix, which includes:

a monomer (i) comprising from 0 to 40 weight percent of an alkyl methacrylate or alkyl acrylate in which the alkyl group contains from 1 to 6 carbon atoms, and various mixtures thereof, a monomer (ii) comprising from 30 to 90 weight percent of an alkyl methacrylate or alkyl acrylate in which the alkyl group contains from 7 to 15 carbon atoms, and various mixtures thereof, and a monomer (iii) comprising from 0 to 40 weight percent of an alkyl methacrylate or alkyl acrylate in which the alkyl group contains from 16 to 24 carbon atoms, and various mixtures thereof, all the weight percentages being based on the total weight of said modifier solids.

"GPC weight average molecular weight" means the weight average molecular weight determined by gel permeation chromatography (GPC) which is described on page 4, Chapter I of The Characterization of Polymers published by Rohm and Haas Company, Philadelphia, Pa. in 1976, utilizing polymethyl methacrylate as the standard.

The first step of the method of the present invention includes dissolving a modifier in a conventional finishing oil to produce a modified finishing oil having increased viscosity. The amount of modifier dissolved in the finishing oil varies in the range of from 10 percent to 50 percent, preferably in the range of from 15 percent to 40 percent, most preferably in the range of from 25 to 35 percent, all by weight percentages being based on the total weight of the modified finishing oil for increase the viscosity of the resulting modified oil in the range of from 10 percent to 500 percent, preferably in the range of from 50 percent to 200 percent, over that provided by the finishing oil before it is modified by the method of the present invention.

Some of the modifiers suitable for use in the present invention include polymers polymerized from the following list of monomers. For, example, the monomers used in the present invention can be a single monomer or a mixture having different numbers of carbon atoms in the alkyl portion. The alkyl portion of the methacrylate and acrylate monomers is an important factor in the performance characteristics of the polymers of the invention. By this is meant that the average number (n) of carbon atoms ($C_n$) in the side chain alkyl groups of the acrylate or methacrylate backbone polymer is selected to maximize viscosity characteristics of the resulting modifier. The modifier of the present invention is a copolymer polymerized from monomers selected from the group consisting of ($C_1$–$C_{24}$) alkyl methacrylates, ($C_1$–$C_{24}$) alkyl acrylates and a mixture thereof. Generally, when the average $C_n$ is less than about 7, the resultant polymers may have poor solubility in the finishing oils, which is desirable for improving the pull-up characteristic of a leather substrate. The average number of carbon atoms in the alkyl group of the acrylate or methacrylate monomers used to prepare the polymeric additives varies from 7 to 18, preferably from 8 to 12. In the instance where the monomers are all acrylates or substantially all acrylates, then the average carbon number of the side chain alkyl groups of the backbone polymer will vary somewhat and the average number of carbon atoms will be that which matches the solubility parameters of the corresponding methacrylate backbone polymers. Such solubility parameters are readily known and understood by those in the art.

To obtain a balance of desired performance characteristics relating to viscosity improvement, better ability to spread over the leather substrate, monomers comprising a mixture of alkyl methacrylates and alkyl acrylates is used. Consequently, in one embodiment of the invention, the modifier is polymerized from a monomer mix, which includes a monomer (i) comprising from 0 to 40 weight percent of an alkyl methacrylate or alkyl acrylate in which the alkyl group contains from 1 to 6 carbon atoms, and various mixtures thereof, a monomer (ii) comprising from 30 to 90 weight percent of an alkyl methacrylate or alkyl acrylate in which the alkyl group contains from 7 to 15 carbon atoms, and various mixtures thereof, and a monomer (iii) comprising from 0 to 40 weight percent of an alkyl methacrylate or alkyl acrylate in which the alkyl group contains from 16 to 24 carbon atoms, and various mixtures thereof. All the percentages are based on the total weight of the modifier solids and the total of monomers (i), (ii) and (iii) equals 100 percent of the weight of the modifier. The amount of monomers (i) in the modifier preferably varies from 0 to 25 weight percent; the amount of monomers (ii) preferably varies from 45 to 85 weight percent and more preferably from 50 to 60 weight percent; and the amount of monomers (iii) varies from 5 to 35 weight percent and more preferably from 25 to 35 weight percent.

Examples of monomer mix which include alkyl methacrylate or alkyl acrylate where the alkyl group contains from 1 to 6 carbon atoms is referred to as "low-cut" alkyl methacrylate or alkyl acrylate and some of the suitable monomers are methyl methacrylate (MMA), methyl and ethyl acrylate, propyl methacrylate, butyl methacrylate (BMA) and acrylate (BA), isobutyl methacrylate (IBMA), hexyl and cyclohexyl methacrylate, cyclohexyl acrylate and combinations thereof. Preferred low-cut alkyl methacrylates are methyl methacrylate and butyl methacrylate.

Examples of monomer mix which include alkyl methacrylate or alkyl acrylate where the alkyl group contains from 7 to 15 carbon atoms is referred to as "mid-cut" alkyl methacrylates or alkyl acrylates and some of the suitable monomers are 2-ethylhexyl acrylate (EHA), 2-ethylhexyl methacrylate, octyl methacrylate, decyl methacrylate, isodecyl methacrylate (IDMA, based on branched ($C_{10}$)alkyl isomer mixture), undecyl methacrylate, dodecyl methacrylate (also known as lauryl methacrylate), tridecyl methacrylate, tetradecyl methacrylate (also known as myristyl methacrylate), pentadecyl methacrylate and combinations thereof. Also useful are: dodecyl-pentadecyl methacrylate (DPMA), a mixture of linear and branched isomers of dodecyl, tridecyl, tetradecyl and penta-decyl methacrylates; and lauryl-myristyl methacrylate (LMA), a mixture of dodecyl and tetradecyl methacrylates. Preferred mid-cut alkyl methacrylates are lauryl-myristyl methacrylate and isodecyl methacrylate.

Examples of monomer mix which include alkyl methacrylate or alkyl acrylate where the alkyl group contains from 16 to 24 carbon atoms is referred to as "high-cut" alkyl methacrylates or alkyl acrylates and some of the suitable monomers are hexadecyl methacrylate, heptadecyl methacrylate, octadecyl methacrylate, nonadecyl methacrylate, cosyl methacrylate, eicosyl methacrylate and combinations thereof. Also useful are: cetyl-eicosyl methacrylate (CEMA), a mixture of hexadecyl, octadecyl, cosyl and eicosyl methacrylate; and cetyl-stearyl methacrylate (SMA), a mixture of hexadecyl and octadecyl methacrylate. Preferred high-cut alkyl methacrylates are cetyl-eicosyl methacrylate and cetyl-stearyl methacrylate.

The mid-cut and high-cut alkyl methacrylate and alkyl acrylate monomers described above are generally prepared by standard esterification procedures using technical grades of long chain aliphatic alcohols, and these commercially available alcohols are mixtures of alcohols of varying chain lengths containing between 10 and 15 or 16 and 20 carbon atoms in the alkyl group. Consequently, for the purposes of this invention, alkyl methacrylate is intended to include not only the individual alkyl methacrylate product named, but to also include mixtures of the alkyl meth-acrylates with a predominant amount of the particular alkyl methacrylate named. The use of these commercially available alcohols to prepare acrylate and meth-acrylate esters results in the LMA, DPMA, SMA and CEMA monomer mixtures described above.

Preferred polymers are polymerized from a monomer mix wherein monomer (i) is selected from the group consisting of methyl methacrylate, butyl methacrylate, isobutyl methacrylate and various mixtures thereof; monomer (ii) is selected from the group consisting of 2-ethylhexyl methacrylate, isodecyl methacrylate, dodecyl-pentadecyl methacrylate, lauryl-myristyl methacrylate and various mixtures thereof; monomer (iii) is selected from the group consisting of cetyl-stearyl methacrylate, cetyl-eicosyl methacrylate and various mixtures thereof.

A more preferred polymer is polymerized from a monomer mixture in a mineral oil, such as, paraffin oil, wherein the monomer mixture includes 28.5 weight percent butyl methacrylate, 38.3 weight percent isodecyl methacrylate and 33.2 weight percent stearyl methacrylate. All weight percentages being based on total weight percent of the polymer solids.

A preferred polymer is polymerized from a monomer mixture in the mineral oil, wherein the monomer mixture includes 10 weight percent methyl methacrylate, 62 weight percent isodecyl methacrylate, 28 weight percent cetyl-stearyl or cetyl-eicosyl methacrylate and various mixtures thereof. All weight percentages being based on total weight percent solids.

Another suitable polymer is polymerized from a monomer mixture in the mineral oil, wherein the monomer mixture includes from 5 to 10 weight percent methyl methacrylate, from 85 to 90 weight percent lauryl-myristyl, isodecyl or dodecyl-pentadecyl methacrylate, from 0 to 5 weight percent cetyl-eicosyl methacrylate and various mixtures thereof. All weight percentages being based on total weight percent of the polymer solids.

Another suitable polymer is polymerized from a monomer mixture in the mineral oil, wherein the monomer mixture includes from 0 to 5 weight percent methyl methacrylate, from 80 to 90 weight percent lauryl-myristyl methacrylate, from 0 to 10 weight percent cetyl-eicosyl methacrylate and various mixtures thereof. All weight percentages being based on total weight percent of the polymer solids.

Another suitable polymer is polymerized from a monomer mixture in the mineral oil, wherein the monomer mixture includes from 0 to 20 weight percent butyl methacrylate, from 65 to 90 weight percent lauryl-myristyl methacrylate, from 0 to 10 weight percent cetyl-eicosyl methacrylate and various mixtures thereof. All weight percentages being based on total weight percent of the polymer solids.

Besides the average number (n) of carbon atoms ($C_n$) in the side chain alkyl group of the acrylate or methacrylate backbone polymer, the nature of the alkyl portion of the methacrylate and acrylate monomers is an important factor in the performance characteristics of the polymer modifiers of the invention, for example, a mix of ($C_1$–$C_6$)alkyl methacrylates or acrylates. Consequently, it is preferred that a portion of monomer mixture comprise from 5 to 40, preferably from 5 to 35 and more preferably from 25 to 35 weight percent of ($C_{16}$–$C_{24}$)alkyl methacrylates and ($C_{16}$–$C_{24}$)alkyl acrylates, preferably wherein the alkyl portion is $C_{16}$ to $C_{20}$.

The optimization of the ratio of the high-, mid- and low-cut alkyl methacrylates is dependent on the finishing oils used in the formulation and the level of performance desired. Once the high-cut monomer is optimized then the mid- and low-cut monomer ratios are balanced to give optimum viscosity thickening and solubility. The balanced formulation will have an alkyl carbon content ($C_n$) of from about 8 to about 10.

In order to achieve the combination of the solubility of the modifier in the finishing oil, its viscosity thickening and its ability to spread easily over the leather substrate the levels of low-cut ($C_1$–$C_3$)alkyl methacrylates, such as methyl methacrylate, may be varied from zero to 25 weight percent, preferably from 5 to 15 weight percent, all weight percentages based on the total by weight of the polymer solids. Polymer solubility refers to the property in which the more hydrophilic or polar monomers, such as, those having a low carbon content ($C_1$–$C_3$) in the alkyl portion, provide a polymer that is less soluble in the finishing oils than polymers from the more hydrophobic monomers, such as, those having a high carbon content ($C_4$ or greater) in the alkyl chain.

The weight-average molecular weight of the modifier of the present invention should be sufficient to impart the desired viscosity properties to the finishing oil. As the weight-average molecular weights of the polymers increase, they become more efficient thickeners; however, they may become so thick that it would be difficult to apply over the leather substrate. Thus, the GPC weight average molecular weight is ultimately governed by thickening efficiency and the type of application. In general, the modifiers of the present invention have a GPC weight average molecular weight varying from 50,000 to 2,000,000; preferably from 250,000 to 1,000,000 and more preferably from 80,000 up to 150,000.

The polymers of this invention are prepared by mixing monomers in the presence of a polymerization initiator, a diluent and optionally a chain transfer agent. The reaction can be run under agitation in an inert atmosphere at a temperature of from 60° to 140° C. and more preferably from 115° to 125° C. Typically, the batch will exotherm to the polymerization temperature of 115° to 120° C. The reaction is run generally for 4 to 10 hours or until the desired degree of polymerization has been reached. As is recognized by those skilled in the art, the time and temperature of the reaction are dependent on the choice of initiator and can be varied accordingly.

Initiators useful for this polymerization are any of the well known free-radical-producing compounds such as peroxy, hydroperoxy and azo initiators including acetyl peroxide, benzoyl peroxide, lauroyl peroxide, t-butyl peroxyisobutyrate, caproyl peroxide, cumene hydroperoxide, 1,1-di(t-butylperoxy)-3,3,5-tri-methylcyclohexane, azobisisobutyronitrile and t-butyl peroctoate. The initiator concentration is normally varied from 0.025 and 1 weight percent based on the total weight of the monomers and more preferably varied from 0.05 to 0.25 weight percent. Chain transfer agents may also be added to the polymerization reaction to control the molecular weight of the polymer. The preferred chain transfer agents are alkyl mercaptans, such as, lauryl (dodecyl) mercaptan, and the concentration of chain transfer agent used is varied from 0 to 0.5 percent by weight.

Among the diluents suitable for the polymerization are aromatic hydrocarbons, such as, benzene, toluene, xylene, and aromatic naphthas; chlorinated hydrocarbons, such as, ethylene dichloride; esters, such as, ethyl propionate or butyl acetate; and petroleum oils.

After the polymerization, the resultant polymer solution has a polymer content varying from 50 to 95 by weight percent based on the total weight of the modifier. The polymer can be isolated and used directly in mineral or synthetic base oils or the polymer and diluent solution can be used in a concentrate form. When used in the concentrate form the polymer concentration can be adjusted to any desirable level with additional diluent (paraffinic base oil). The preferred concentration of polymer in the concentrate varies from 30 to 70 by weight percent, most preferred varying from 35 to 45 weight percent. When the concentrate is directly blended into a diluent, the more preferred diluent being any mineral oil, such as, 100 to 150 neutral oil (100 N or 150 N oil) that is compatible with the finishing oil. Preferred mineral oil is supplied by Sun oil Corporation of Philadelphia, Pa., under the trade name Sun HPO™ 100 mineral oil.

The finishing oil suitable for use in the method of the present invention may be any conventional oil-based finishing oil known in the art, including emulsified oils. The finishing oils are also sometimes known as "fatliquors" or "oiling-off oils". Several examples of which are provided on pages 139 through 151 of the *Pocket Book for the Leather Technologist,* second edition, identified as B 352 e/ (791) 8.82 and published by BASF Aktiengesellchaft, D-6700, Ludwigshafen, Federal Republic of Germany; in *Synthetic fatliquors in theory and practice,* by Dr. Th Bohme, pages 40, 42, 43, 80 and 81 in Science and Technology, in *Fatliquors and Fatliquoring of Leather* by Samir Das Gupta, Technical Director, Atlas Refinery, Newark, N.J., pages 1 through 23; in Material Safety Data Sheet for Aversing° KCO blend of fatty esters supplied by Henkel Corporation, Oak Creek, Wis.; and in U.S. Pat. No. 5,330,537 assigned to Rohm and Haas company, Philadelphia, Pa. all of which are hereby incorporated herein by reference. Non-emulsified finishing oils are preferred. The finishing oil having a trade name Aversin® KCO blend of fatty esters supplied by Henkel Corporation, Oak Creek, Wis. is particularly preferred.

The second step of the method of the present invention includes applying a layer of the modified finishing oil of the present invention over the grain side surface of the leather substrate. Any conventional applying means, such as, a contact transfer roller, which is continuously coated with the modified finishing oil of the present invention transferred from conventional storage means, such as, a trough, in contact with the contact transfer roller, are suitable. The roller coated with the modified finishing oil of the present invention then comes in contact with the leather substrate surface and transfers the oil thereto. The amount of the modified finishing oil of the present invention transferred from the conventional storage means, such as, the trough, may be advantageously metered by metering means, such as, a doctor blade. Generally, the amount of the modified finishing oil of the present invention applied by the applying means on the grain side of the leather substrate plays a role in improving the pull-up characteristic of the leather substrate. Typically, the desired degree of the pull-up characteristic of the leather substrate is best attained by applying the modified finishing oil of the present invention in the range of from 2.5 to 50 grams per square feet, preferably 5 to 20 grams per square feet, most preferably 20 to 35 grams per square feet of the grain side of the leather substrate surface.

If desired, the method of the present invention may further include heating the modified finishing oil at elevated temperatures, typically varying from 30° to 120° C., preferably from 30° to 70° C. before the modified finishing oil is applied to the grain side of the leather substrate. The degree of heating of the modified finishing oil generally depends upon the amounts of waxy components typically present in the finishing oils and their melting points. Thus, if high amounts of waxy components having high melting points are present in the modified finishing oil, higher will be the amount of heating necessary for uniform and smooth flowing of the modified finishing oil during the application step on the leather surface.

If desired, the method of the present invention may further include ironing or plating of the leather substrate after its grain side has been coated with a layer of the modified finishing oil of the present invention to further improve the pull-up characteristic of the leather substrate. The term "ironing" means pressing a roller against the coated leather substrate. Generally, the pressure applied by the roller during the ironing step varies from 25 to 300, preferably from 100 to 250, all in kilograms per square centimeters. The rollers are preferably heated in the range of from 50° to 300° C., preferably in the range of from 90° to 200° C.; and during the ironing step for further improving the pull-up characteristic of the leather substrate.

Alternatively or in conjunction with the ironing step, the method of the present invention may further include plating of the leather substrate after its grain side has been coated with the layer of the modified finishing oil of the present invention to further improve the pull-up characteristic of the leather substrate. The term "plating" means pressing a plate of a desired shape and size against the coated leather substrate. Generally, the pressure applied by the plate during the plating step varies from 25 to 300, preferably from 100 to 250, all in kilograms per square centimeters. The plates are preferably heated in the range of from 50° to 300° C., preferably in the range of from 90° to 200° C. during the plating step for further improving the pull-up characteristic of the leather substrate.

If desired, the roller or plate described earlier may be provided with patterns, engraved thereon, to emboss or pattern the desired design patterns, such as, leather pattern of a more expensive leather, or any another desired pattern, on the grain side of leather substrate.

The present invention is also directed to a modified finishing oil suitable for improving the pull-up characteristic of the leather substrate attained by utilizing the method of the present invention. The compositional details of the modified finishing oil of the present invention are the same as those previously described.

The method of the present invention may be advantageously used in coating leather articles, such as, shoes, hand gloves, purses, clothing, hats and any other leather article requiring esthetic and visual appeal to a consumer.

The following Examples are provided to further illustrate the invention.

Modifier

A monomer mix was prepared from 33.2 parts stearyl methacrylate (100% basis, 95% purity), 38.3 parts isodecyl methacrylate (100% basis, 98% purity), 28.5 parts butyl methacrylate, 0.06 parts dodecyl mercaptan, and 0.17 parts t-butyl peroctoate (50% purity in mineral spirits). A heel charge was prepared from 20.0 parts paraffinic base oil (100 N oil supplied by BP oil, United Kingdom) and 0.028 parts t-butyl peroctoate (50% purity in mineral spirits). The heel charge was then charged to a nitrogen flushed kettle fitted with a thermometer and Thermowatch™ to control temperature, a water-cooled reflux condenser with nitrogen outlet, a stirrer, a nitrogen inlet, and a funnel for adding reactants to the kettle. The contents of the kettle were heated and maintained at 120° C. The monomer mix (100 parts) was then added uniformly over a 90 minute period while maintaining the kettle contents at the polymerization temperature varying between 115° to 120° C.

Twenty minutes thereafter, the first of two delayed initiator shots, each containing 0.10 parts t-butyl peroctoate (50% purity in mineral spirits) in 5.0 parts paraffinic base oil, were added. The second initiator shot was added twenty minute later. Twenty minutes after the second initiator addition, about 62 parts of paraffinic base oil was added to bring the batch to a theoretical solids of 50% polymer in oil. Throughout the polymerization, the batch temperature was maintained at 115°–120° C. Thirty minutes thereafter 95 percent of the monomer mix was polymerized into the modifier.

Series of modified finishing oils, described in Table 1 below, were prepared by dissolving Modifier described above in the finishing oil sold under the trade name Aversin® KCO, a blend of fatty esters, supplied Henkel Corporation, Oak Creek, Wis. Different weight percentages were utilized to obtain modified finishing oils having different viscosities. Example 1 in Table 1 was a control sample having no modifier dissolved in it.

TABLE 1

| | Example 1 | Example 2 | Example 3 | Example 4 | Example 5 | Example 6 | Example 7 | Example 8 |
|---|---|---|---|---|---|---|---|---|
| $A^1$ | 650 | 600 | 550 | 500 | 450 | 400 | 350 | 300 |
| $B^2$ | 350 | 350 | 350 | 350 | 350 | 350 | 350 | 350 |
| $C^3$ | 0 | 50 | 100 | 150 | 200 | 250 | 300 | 350 |
| $D^4$ | 65 | 65 | 72 | 80 | 92 | 100 | 110 | 110 |

$A^1$ refers to Aversin ® KCO, a blend of fatty esters in grams;
$B^2$ refers to Mineral spirits in grams supplied by Exxon Chemicals, Americas;
$C^3$ refers to Modifier described above in grams; and
$D^4$ refers to the shear viscosity in cps of the modified finishing oil obtained by using ICI high shear cone plate viscometer conducted under ASTM D 4287.

From Table 1, it is seen that as the percentage of the modifier dissolved in the finishing oil was increased, the viscosity of the resulting modified finishing oil also increased.

A fixed amount, i.e., 0.1 ml, of the modified finishing oils described in Examples 1 through 8, shown in Table 1, was applied over the grain side surface of various leather substrates to determine the effect of dissolving increasing amounts of the modifier of the present invention in the finished oil by measuring the time (open time) it took for the modified oil to completely absorb from the various leather substrates surface, i.e., time required for the fixed amount of modified oil to get completely absorbed within the various leather substrates. The results are provided in Table 2 below:

TABLE 2

| | Example 1 | Example 2 | Example 3 | Example 4 | Example 5 | Example 6 | Example 7 | Example 8 |
|---|---|---|---|---|---|---|---|---|
| E | 2.31 | 2.47 | 4.02 | 4.07 | 4.45 | 5.40 | 5.15 | 6.22 |
| F | 1.10 | 1.20 | 1.30 | 2.10 | 2.57 | 3.37 | 3.07 | 3.20 |
| G | 1.27 | 1.45 | 1.52 | 1.55 | 2.17 | 2.30 | 2.22 | 2.22 |

*time provided in minutes and seconds, (minutes . seconds);
E refers to a leather sample substrate (thickness at 1.5 millimeters), which is a light weight, softer, full grain chrome tanned leather substrate with light retannage;
F refers to a leather sample substrate (thickness at 2.5 millimeters), which is a buffed grain, heavy weight chrome tanned with Syntan retannage; and
G refers to a leather substrate (thickness at 2.5 millimeters), which is heavy weight, moccasin leather substrate chrome tanned with heavy vegetable retannage.

From Table 2, it is seen that as the viscosity of the modified finishing oil increased, the open time available for spreading the modified finishing oil over larger area also increased. Furthermore, when the flesh side of the various substrates was analyzed, it was observed that increasingly less amount of the modified finishing oil had penetrated to the flesh side as the percentage of the modifier dissolved in the finishing oil increased, Example 1 (unmodified control sample) exhibited maximum penetration and Example 8 exhibited least amount of penetration.

We claim:

1. A method of improving the pull-up charateristic of a finished leather substrate comprising:

dissolving a modifier in a finishing oil to form a modified finishing oil wherein the viscosity of said finishing oil is increased by from 10 percent to 500 percent, said modifier polymerized from a monomer mix comprising:

a monomer (i) comprising from 0 to 40 weight percent of an alkyl methacrylate or alkyl acrylate in which the alkyl group contains from 1 to 6 carbon atoms, and mixtures thereof, a monomer (ii) comprising from 30 to 90 weight percent of an alkyl methacrylate or alkyl acrylate in which the alkyl group contains from 7 to 15 carbon atoms, and mixtures thereof, and a monomer (iii) comprising from 0 to 40 weight percent of an alkyl methacrylate or alkyl acrylate in which the alkyl group contains from 16 to 24 carbon atoms and mixtures thereof, all the weight percentages being based on the total weight of the modifier solids; and applying a layer of said modified finishing oil to said finished leather substrate to improve its said pull-up characteristic over that provided by said finishing oil.

2. The method of claim 1 wherein said modified finishing oil comprises from 10 percent by weight to 50 percent by weight said modifier, based on the total weight of said modified finishing oil.

3. The method of claim 1 wherein said modifier is a copolymer polymerized from monomers selected from the group consisting of ($C_1$–$C_{24}$) alkyl methacrylates, ($C_1$–$C_{24}$) alkyl acrylates and a mixture thereof.

4. The method of claim 1 further comprising heating said modified finishing oil to an elevated temperature ranging from 30° to 120° C.

5. The method of claim 1 or 4 further comprising ironing, plating or ironing and plating of said substrate having said layer of said modified finishing oil thereon to further improve said pull-up characteristic.

6. The method of claim 5 wherein said ironing step comprises passing said substrate under pressure varying in the range from 25 to 300 kilograms per square centimeters provided by a hot roller heated to a temperature in the range of from 50° to 300° C.

7. The method of claim 5 wherein said plating step comprises applying pressure varying in the range of from 25 to 300 kilograms per square centimeters by means of a hot plate heated to a temperature in the range of from 50° to 300° C.

8. The method of claim 1 wherein during said applying step from 2.5 grams of said modified finishing oil per square foot of said leather substrate surface to 50 grams of said modified finishing oil per square foot of said leather substrate surface is applied.

9. The method of claim 1 wherein said modified finishing oil comprises from 15 percent by weight to 40 percent by weight of said modifier, all weight percentages being based on the total weight of said modified finishing oil.

10. The modified finishing oil of claim 1 wherein said modifier has a GPC weight average molecular weight varying from 50,000 to 2,000,000.

11. The method of claim 1 wherein said modified finishing oil is applied on the grain side of said leather substrate.

12. The method of claim 11 wherein said modified finishing oil has a reduced rate of migration from said grain side to the flesh side of said leather substrate compared to that provided by said finishing oil.

13. The method of claim 11 wherein said modified finishing oil covers up to 30 percent more surface area of said grain side than that covered by applying said finishing oil.

14. A leather substrate having improved pull-up characteristic produced in accordance with the method of claim 1.

15. A method of improving the pull-up characteristic of a finished leather substrate comprising:

dissolving a modifier in a finishing oil to form a modified finishing oil for increasing the viscosity of said finishing oil by from 10 percent to 500 percent to thereby reduce the rate of migration of said modified oil from the grain side to the flesh side of said finished leather substrate compared to that provided by said finishing oil, said modifier polymerized from a monomer mix comprising:

a monomer (i) comprising from 0 to 40 weight percent of alkyl methacrylate or alkyl acrylate in which the alkyl group contains from 1 to 6 carbon atoms, and mixtures thereof, a monomer (ii) comprising from 30 to 90 weight percent of an alkyl methacrylate or alkyl acrylate in which the alkyl group contains from 7 to 15 carbon atoms, and mixtures thereof, and a monomer (iii) comprising from 0 to 40 weight percent of an alkyl methacrylate or alkyl acrylate in which the alkyl group contains from 16 to 24 carbon atoms, and mixtures thereof, all the weight percentages being based on the total weight of the modifier solids; and applying said modified finishing oil on the grain side of said finished leather substrate for improving said pull-up characteristic of said finished leather substrate over that provided by said finishing oil.

16. The method of claim 15 wherein said modified finishing oil covers up to 30 percent more surface area of said grain side of said finished leather substrate than that covered by applying said finishing oil.

* * * * *